US005106436A

United States Patent [19]

Alabi

[11] Patent Number: 5,106,436

[45] Date of Patent: Apr. 21, 1992

[54] WEAR RESISTANT EUTECTIC ALUMINUM-SILICON ALLOY

[75] Inventor: Muftau M. Alabi, Amherst, N.Y.

[73] Assignee: General Motors Corporation, Detroit, Mich.

[21] Appl. No.: 767,433

[22] Filed: Sep. 30, 1991

[51] Int. Cl.[5] ..... C22C 21/04

[52] U.S. Cl. ..... 148/438; 420/537; 420/538

[58] Field of Search ..... 420/537, 538; 148/438, 148/11.5 A

[56] References Cited

U.S. PATENT DOCUMENTS 4,681,736 7/1987 Kersker et al. ..... 148/438
4,737,206 4/1988 Iwai ..... 148/438

FOREIGN PATENT DOCUMENTS 2124748 10/1972 France ..... 148/438
541885 1/1977 U.S.S.R. ..... 420/538
1340489 12/1973 United Kingdom ..... 420/538

*Primary Examiner*—R. Dean
*Assistant Examiner*—Sikyin Ip
*Attorney, Agent, or Firm*—George A. Grove

[57] ABSTRACT

An improved eutectic aluminum-silicon alloy having a relatively high level of bismuth is provided which is particularly wear-resistant and sufficiently self-lubricating so as to be suitable for use in a wearing component even when poorly lubricated. The relatively high bismuth level within the alloy cooperates with the other elemental additions so as to provide a sufficiently low friction bearing surface (or self-lubricity), which significantly enhances the wear resistant properties of the alloy. In addition, the preferred alloy also has relatively substantial additions of both nickel and copper, which results in the homogeneous distribution of hard wear resistant nickel and copper phases throughout. The improved aluminum alloy should minimize wear and alleviate galling during use.

6 Claims, No Drawings

WEAR RESISTANT EUTECTIC ALUMINUM-SILICON ALLOY

The present invention generally relates to eutectic aluminum-silicon alloys, particularly those alloys which are used for wear resistance in automotive environments. More particularly, this invention relates to such a eutectic aluminum-silicon alloy having relatively substantial additions of bismuth, as well as copper and nickel, which results in the inventive aluminum-silicon alloy being characterized by enhanced lubricity and a uniform distribution of hard copper and nickel aluminide phases, so as to be extremely useful for wear resistant applications.

BACKGROUND OF THE INVENTION

Air conditioning systems are routinely employed within automobiles and other vehicles for creating comfortable conditions within the passenger compartment for the vehicle occupants. At outside temperatures above about 70° F., it is difficult to maintain a comfortable passenger compartment temperature without first cooling the air that is being blown into the passenger compartment. Typically, cooling of the air is accomplished by first compressing an appropriate refrigerant, such as the generally used fluorocarbons (known commonly as freon) or another alternative refrigerant, using an engine-driven compressor which compresses the vaporized refrigerant.

The materials and components within the air conditioning system must be capable of withstanding extremely demanding conditions, particularly, the materials used to form the components within the engine driven compressor. The compressor contains many mating components which continuously wear against each other during operation of the air conditioning system, while also being subject to significant pressures due to the compressed refrigerant. Appropriate lubricants are provided throughout the compressor at these bearing surfaces, so as to prevent excessive wear and galling between the mating materials. Typically in the past, a lubricant which is soluble in the refrigerant has been added directly in with the refrigerant when charging the compressor with the pressurized refrigerant prior to use. Since the conventional lubricants have been soluble within the refrigerant, the lubricant therefore moves freely through the compressor with the refrigerant, thereby providing lubrication where it is needed most between mating components.

However, due to environmental concerns, the current fluorocarbon-based refrigerants are being eliminated from use. Alternative refrigerants which alleviate environmental damage have been tested, with a 1,1,1,2-Tetrafluoroethane refrigerant, known as R134A, being a likely substitute. Unfortunately, conventional lubricants which have been previously (and successfully) employed with the fluorocarbon-based refrigerants are not soluble within the R134A refrigerant. Therefore the lubricant does not freely move throughout the compressor components when the new refrigerant is used and does not lubricate mating surfaces, as was the situation when the fluorocarbon-based refrigerants were used. The result is that during operation of the air conditioning system with the new R134A refrigerant, the bearing surfaces of the mating components are not lubricated and correspondingly they experience significantly higher incidence of wear.

Therefore, in the absence of an appropriate lubricant, it is necessary to provide a wear resistant material which is essentially self-lubricating. The desired material must be capable of not only providing sufficient lubricity, but must also be sufficiently strong to resist wear and galling during operation of the compressor. In addition, there are certain applications wherein the material must also be sufficiently ductile to permit the formation of a component from the material such as by swaging or other forming techniques. Therefore, the requirements of this material are many.

SUMMARY OF THE INVENTION

It is therefore an object of this invention to provide a wear-resistant eutectic aluminum-silicon alloy particularly suitable for use as a wearing component, such as in a compressor unit of an automobile air conditioning system.

It is a further object of this invention that such a eutectic aluminum-silicon alloy be sufficiently self-lubricating so as to prevent galling during use even when poorly lubricated.

It is yet a further object of this invention that such a eutectic aluminum-silicon alloy be characterized by a uniform distribution of hard wear resistant phases.

In accordance with a preferred embodiment of this invention, these and other objects and advantages are accomplished as follows.

According to the present invention, there is provided an improved eutectic aluminum-silicon alloy having a relatively substantial addition of bismuth. The aluminum-silicon alloy is particularly wear-resistant and sufficiently self-lubricating so as to be suitable for use as a wearing component, such as one which would receive a bearing member within a compressor unit of an automobile air conditioning system. The improved eutectic aluminum-silicon alloy minimizes wear and alleviates galling during use, even when used in a poorly lubricated environment.

In addition, the improved alloy of this invention has relatively high levels of nickel and copper that produce hard, wear resistant phases, $NiAl_3$ and $CuNiAl_3$, which are stable at high temperatures and which are dispersed uniformly throughout the alloy.

The preferred wear resistant eutectic aluminum-silicon alloy is characterized by the following elemental composition, wherein the percentages are weight percents: from about eleven to 13.5 percent silicon with about twelve to thirteen percent being most preferred; from about three to about six percent bismuth with about four to about five percent being most preferred; from about two to about five percent copper with about two to about three percent being most preferred; from about one to about three percent nickel with about 1.5 to about 2.5 percent being most preferred; and from about 0.005 to about 0.020 percent phosphorus.

The preferred aluminum-silicon-copper alloy also consists of up to about one percent iron; up to about 0.5 percent manganese; and up to about 0.25 percent titanium, with the balance of the preferred alloy being aluminum A particularly advantageous feature of the eutectic aluminum-silicon alloy of this invention is that the relatively high level of bismuth remains essentially as elemental bismuth within the alloy. The elemental bismuth provides a lubricating phase that results in a material having a low coefficient of friction at its surfaces. This property of self-lubricity for the preferred alloy enhances the wear resistant properties of the alloy.

Another advantageous feature of the preferred eutectic alloy is that the relatively high nickel and copper content within the alloy causes the formation of the extremely hard $NiAl_3$ and $CuNiAl_3$ phases, which are about half the relative hardness of the primary silicon particles. The hard wear resistant nickel and copper phases are uniformly dispersed throughout the alloy, and therefore enhance the overall wear resistance of the alloy.

Further, the trace amounts of phosphorus within the alloy react with the aluminum to form aluminum phosphide which tends to uniformly precipitate the primary silicon particles throughout the alloy, thereby also enhancing the wear resistance.

Other objects and advantages of this invention will be better appreciated from the following detailed description.

DETAILED DESCRIPTION OF THE INVENTION

According to the present invention, there is provided an improved eutectic aluminum-silicon alloy having a relatively substantial addition of bismuth, as well as substantial additions of copper and nickel also. The improved eutectic aluminum-silicon alloy exhibits good wear-resistance by being sufficiently self- lubricating and having a uniform dispersion of the hard wear resistant phases throughout, and therefore is particularly suited for use as a wearing component.

More specifically, the self-lubricating, wear resistant eutectic aluminum-silicon alloy of this invention is characterized by the preferred elemental composition shown in Table I., wherein the percentages refer to weight percents

TABLE I

| | |
|---|---|
| Si | 11.0%-13.5% |
| Bi | 3.0%-6.0% |
| Cu | 2.0%-5.0% |
| Ni | 1.0%-3.0% |
| P | 0.005%-0.020% |
| Fe | 1.0% (max.) |
| Mn | 0.5% (max.) |
| Ti | 0.25% (max.) |
| Al | Balance |

The silicon (Si) content of the preferred eutectic aluminum-silicon alloy may vary from about eleven to 13.5 percent so as to ensure good wear resistance of the material, with the range of about twelve to about thirteen percent being most preferred. The eutectic point in a pure aluminum-silicon system is approximately 12.3 weight percent silicon within the pure alloy, however due to the additional constituents within the preferred alloy, it is believed that the actual eutectic point is somewhat lower in the preferred alloy, possibly as low as about eleven percent. Therefore, the silicon content of the preferred eutectic aluminum-silicon alloy should remain above about eleven percent.

Maintaining the silicon level above the eutectic point ensures that the hard primary silicon particles will form. These hard primary silicon particles contribute greatly to the wear resistance of the alloy. In addition, the silicon reacts with the aluminum to form hard aluminum-silicon particles which also enhance the wear resistance of the alloy.

The bismuth (Bi) content of the preferred eutectic aluminum-silicon alloy may vary from about three percent to about six weight percent, with a range of about four to about five percent being most preferred. It has been determined that the presence of bismuth within the alloy enhances the lubricity of the alloy by essentially remaining as elemental bismuth within the alloy. The elemental bismuth reduces the coefficient of friction on the bearing surfaces of the alloy. It is this high level of bismuth which enables the preferred alloy to be essentially self-lubricating, thereby alleviating excessive wear and galling of the preferred aluminum-silicon-copper base alloy during use.

An advantageous feature of this invention is that many eutectic aluminum-silicon alloys of this type, which are designed for wear resistance, also contain magnesium for strengthening purposes However, with magnesium present, the bismuth content must be nonexistent or at least limited, since we have determined that the bismuth tends to react with magnesium so as to reduce the strengthening potential of the alloy by detrimentally tying up the magnesium. Therefore, it is generally necessary to eliminate the bismuth content within these types of alloys that require strength. Yet in the preferred alloy of this invention, sufficient strength is achieved without the addition of magnesium, which then permits a relatively large amount of the lubricating bismuth to be used. Hence the alloy of this invention provides a strong yet self-lubricating material.

The preferred eutectic aluminum-silicon alloy of this invention contains relatively high levels of both copper (Cu) and nickel (Ni) which produce extremely hard, wear resistant phases, $NiAl_3$ and $CuNiAl_3$, within the alloy. These phases are characterized by a hardness of about half the hardness of pure silicon. It is preferred that the copper content range from about two to about five weight percent, with about two to about three percent being most preferred; and that the nickel content range from about one to about three weight percent, with about 1.5 to 2.5 percent being most preferred. This amount of each alloy ensures that a sufficient amount of the desired hard phases, $NiAl_3$ and $CuNiAl_3$, will be present during formation of the alloy.

It is to be noted that these hard phases tend to be stable at high temperatures and form in relatively equal amounts depending upon the ratio of nickel to copper within the molten alloy. The nucleation kinetics associated with the formation of these phases, $NiAl_3$ and $CuNiAl_3$, proceeds relatively independently of the cooling rate employed during the casting process for the alloy. Thus, the cast components which may be formed from the preferred alloy are characterized by a uniform distribution of these wear resistant particles throughout. This is particularly advantageous as the uniform distribution of these hard wear resistant particles enhances the overall wear resistance of the alloy.

The preferred eutectic aluminum-silicon alloy also contains a trace amount of phosphorus (P), from about 0.005 to about 0.020 percent with about 0.010 to about 0.020 percent being most preferred. The phosphorus reacts with the aluminum within the molten alloy to form aluminum phosphide. The aluminum phosphide nuclei precipitates the fine primary silicon particles, causing the primary silicon particles to be more homogeneously distributed throughout the alloy, which enhances the overall wear resistance of the alloy. However, only a trace amount of the phosphorus is required to effect the fine distribution of the primary silicon particles, with the preferred phosphorus levels being sufficient.

Further, since it is difficult to add phosphorus directly to the molten alloy because of its fine powdery form, the phosphorus would most probably be added to the molten alloy using conventional phosphorus treatment methods, which include adding a phosphorus containing compound such as a phosphorus-copper compound to the melt during casting. It is important that the phosphorus within the molten alloy be allowed to incubate within the melt for at least about five to ten minutes. This ensures an intimate reaction of the phosphorus within the molten metal so as to sufficiently activate the metal to allow formation of the aluminum phosphide particles.

The preferred iron (Fe) content within the aluminum alloy of this invention may vary up to about 1.0 percent iron, with a maximum level of about 0.8 or less being most preferred. The ductility of the alloy is typically impaired by the presence of iron within the alloy due to the formation of the aluminum-iron-silicon (Al-Fe-Si) compound. Therefore, it is desirable to minimize the iron content within the alloy, yet it is difficult to entirely eliminate the iron within the alloy since this level of iron is typically always present within the secondary aluminum used to form the alloy.

The manganese (Mn) content within the preferred eutectic aluminum-silicon alloy of this invention may vary up to about 0.5 percent, preferably up to only about 0.4 percent, with as minimal a level practical being most preferred. It is noted that this small amount of manganese may be helpful in that the manganese tends to prevent formation of the brittle aluminum-iron-silicon intermetallic phase within the alloy.

The titanium (Ti) content may vary up to about 0.25 percent with a preferred maximum being about 0.2 weight percent. This small amount of titanium is desired since it provides a grain refining effect within the preferred alloy.

The balance of the preferred alloy is aluminum.

The most preferred composition for the alloys, as discussed above, is summarized in Table II. Again, the percentages refer to weight percents

TABLE II

| | |
|---|---|
| Si | 12.0%-13.0% |
| Bi | 4.0%-5.0% |
| Cu | 2.0%-3.0% |
| Ni | 1.5%-2.5% |
| P | 0.01%-0.02% |
| Fe | 0.8% (max.) |
| Mn | 0.4% (max.) |
| Ti | 0.2% (max.) |
| Al | Balance |

It is believed that the preferred eutectic aluminum-silicon alloy could be heat treated using a conventional Thigh aluminum alloy heat treating schedule, so as to maximize the tensile and yield strengths of the alloy. It should be noted that the particular heat treatment schedule employed on the alloy will vary depending on the intended application for the alloy. In particular, any of the T6 aluminum heat treating schedules which basically solution heat treat, quench and then artificially age the alloy would probably be suitable with the preferred alloy of this invention.

It is also presumed that upon conventional metallographic examination, the microstructure of the alloy would exhibit well-dispersed primary silicon, aluminum-silicon and bismuth phases throughout the aluminum matrix of the alloy. The presence of these hard silicon particles within the alloys of this invention have been found to significantly improve their wear and galling resistant properties.

In addition, it is believed that the cast alloy would exhibit uniform distribution of the hard wear resistant particles, $NiAl_3$ and $CuNiAl_3$, throughout the alloy. An advantage of this alloy, is that the formation of these hard copper/nickel/aluminum phases occurs relatively independent of temperature, so that after cooling, these hard phases can be found in regions where other elements (such as silicon) may be depleted, i.e., specifically at the cast surfaces which cool most rapidly during casting—particularly when die casting the alloy. The presence of these hard phases results in an increase in the matrix strength of the cast component and improved wear resistance even under severe conditions where little lubrication is present, such as within automotive air conditioning compressor components.

Therefore, the alloy of this invention should exhibit enhanced wear and galling resistance in an actual wearing environment, due to the uniform distribution of hard particles and high aluminum matrix strength of the alloy, particularly when coupled with its lubricity.

In summary, there are many advantageous features associated with the eutectic aluminum-silicon alloy of this invention. The relatively high level of bismuth within the alloy cooperates with the other elemental additions by providing a sufficiently self-lubricating, low friction surface which, in turn, enhances the wear and galling resistant properties of the alloy, as well as its machinability. Further, in addition to the hard primary silicon and aluminum-silicon particles which provide wear resistance, the relatively high nickel and copper content within the alloy causes the formation of uniformly dispersed, extremely hard $NiAl_3$ and $CuNiAl_3$ phases. Because the formation of these hard wear resistant particles is relatively independent of cooling rate, the preferred alloy is well suited for die casting techniques. Die cast components formed from the alloy of this invention would be essentially ready to use after casting without the requirement for further etching to expose the wear resistant particles.

Therefore, while our invention has been described in terms of a preferred embodiment, it is apparent that other forms could be adopted by one skilled in the art, such as by modifying the aluminum alloy within the preferred ranges of element concentrations, or by modifying the processing steps, or by employing the alloy in an alternative environment. Accordingly, the scope of our invention is to be limited only by the following claims.

The embodiments of the invention in which an exclusive property or privilege is claimed are defined as follows:

1. A wear resistant eutectic aluminum-silicon alloy having sufficient lubricity so as to prevent wear and galling even when poorly lubricated, and characterized by a uniform dispersion of wear resistant particles throughout, said wear resistant eutectic aluminum-silicon alloy consisting essentially of the following by weight:

from about eleven to about 13.5 percent silicon;
from about three to about six percent bismuth;
from about two to about five percent copper;
from about 1.5 to about three percent nickel;
from about 0.005 to about 0.020 percent phosphorus;

at most about 1.0 percent iron;
at most about 0.5 percent manganese;
at most about 0.25 percent titanium; and
the balance being substantially all aluminum;
such that said bismuth essentially remains in its elemental form within said wear resistant alloy so as to provide lubricity to said wear resistant alloy, while said silicon and aluminum sufficiently react with each other to form a hard primary silicon phase, and said nickel and copper additions sufficiently react with said aluminum so as to form hard $NiAl_3$ and $CuNiAl_3$ phases, and wherein the formation of said hard nickel and copper phases is relatively independent of temperature thereby resulting in the homogeneous dispersion of said hard nickel and copper phases throughout said wear resistant eutectic aluminum-silicon alloy.

2. A wear resistant eutectic aluminum-silicon alloy as recited in claim 1 wherein said silicon ranges from about twelve to about thirteen percent.

3. A wear resistant eutectic aluminum-silicon alloy as recited in claim 1 wherein said bismuth ranges from about four to about five percent.

4. A wear resistant eutectic aluminum-silicon alloy as recited in claim 1 wherein said copper ranges from about two to about three percent.

5. A wear resistant eutectic aluminum-silicon alloy as recited in claim 1 wherein said nickel ranges from about 1.5 to about 2.5 percent.

6. A wear resistant eutectic aluminum-silicon alloy having sufficient lubricity so as to prevent wear and galling even when poorly lubricated, and being characterized by a uniform dispersion of wear resistant particles throughout, said wear resistant eutectic aluminum-silicon alloy consisting essentially of the following by weight:

from about twelve to about thirteen percent silicon;
from about four to about five percent bismuth;
from about two to about three percent copper;
from about 1.5 to about 2.5 percent nickel;
from about 0.01 to about 0.02 percent phosphorus;
at most about 0.8 percent iron;
at most about 0.4 percent manganese;
at most about 0.2 percent titanium; and
the balance being substantially all aluminum;
such that said bismuth essentially remains in its elemental form within said wear resistant alloy so as to provide lubricity to said wear resistant alloy, while said silicon and aluminum sufficiently react with each other so as to form a hard primary silicon phase, and said nickel and copper additions sufficiently react with said aluminum so as to form hard $NiAl_3$ and $CuNiAl_3$ phases, and wherein the formation of said hard nickel and copper phases is relatively independent of temperature thereby resulting in the homogeneous dispersion of said hard nickel and copper phases throughout said wear resistant eutectic aluminum-silicon alloy.

* * * * *